US005402958A

United States Patent [19]

Mahaney

[11] Patent Number: 5,402,958

[45] Date of Patent: Apr. 4, 1995

[54] TAMPER EVIDENT SEAL

[75] Inventor: John C. Mahaney, Spencer, Mass.

[73] Assignee: Inner-Tite Corporation, Holden, Mass.

[21] Appl. No.: 57,959

[22] Filed: Apr. 20, 1993

[51] Int. Cl.[6] ..... B65H 75/02

[52] U.S. Cl. ..... 242/388.1; 24/68 R; 24/68 SK; 292/307 R

[58] Field of Search ..... 24/71.1, 68 R, 68 CD, 24/71.2, 68 SK; 292/307 R, 256.6; 254/223; 242/338.1

[56] References Cited

U.S. PATENT DOCUMENTS

| | | | |
|---|---|---|---|
| 421,951 | 2/1890 | MacCarthy . | |
| 1,911,060 | 5/1933 | Clark . | |
| 2,144,336 | 1/1939 | Katz . | |
| 3,612,339 | 10/1971 | Jorgensen . | |
| 4,396,113 | 8/1983 | Gail et al. . | |
| 4,978,026 | 12/1990 | Gnoinski . | |
| 5,065,481 | 11/1991 | Walkhoff | 24/71.2 X |

*Primary Examiner*—James R. Brittain

*Attorney, Agent, or Firm*—Samuels, Gauthier & Stevens

[57] ABSTRACT

A tamper evident seal for assembled components having aligned apertures. The seal includes a hollow housing, a stem, a flexible elongated element, a means for rotating the stem, and a means for opposing the rotation of the stem. The hollow housing has a circular side wall surrounding a central axis, and the side wall has a first wall opening. The stem is contained within the housing for rotation about the axis, and the stem has a stem opening aligned at an initial setting with the first wall opening. The flexible elongated element protrudes from the housing. The means for rotating the stem operates in one direction. The means for opposing rotation of said stem relative to the housing opposes rotation in the opposite direction. In use, the free end of the flexible element is passed through the aligned apertures of the assembled components and then through the circular side wall and stem via the wall and stem openings. The stem is then rotated in the one direction relative to the housing to wrap a segment of the element about the stem.

23 Claims, 5 Drawing Sheets

TAMPER EVIDENT SEAL

BACKGROUND OF THE INVENTION

1. Field of the Invention

The invention relates to tamper evident seals of the type used to provide visual evidence of unauthorized access to and/or tampering with locks and other like security devices. The invention is especially useful for, although not limited to, maintaining the security of meters employed by utility companies to monitor customers' energy consumption.

2. Description of the Prior Art

Conventionally, tamper evident seals for use with security devices include a slender flexible element, typically a metallic wire, formed into a half loop having two interconnected arms. One arm is threaded through aligned apertures in the interlocked components to be safeguarded against tampering, and portions of both arms are then captured within a seal body.

In an earlier seal version, the seal body is formed of a malleable metal, typically lead. The body is crimped onto the two wire arms by a special tool designed to leave a visually distinctive permanent impression. In theory, any attempt to dislodge the seal body from the wire will result in the crimped impression being altered, thereby providing visual evidence of tampering. In practice, however, tampering remains possible, typically by heating the seal body sufficiently to soften the metal without altering its exterior appearance, thereby permitting the wire to be extricated and reinserted without visibly altering the overall appearance of the seal.

Such seals are also designed to be used once and then discarded. Improper disposal of lead seal bodies raises health and environmental concerns, particularly in crowded urban areas where frequent access to utility meters by maintenance personnel is required.

Attempts have been made at dealing with the above described problems by developing new seals wherein the flexible elements and seal bodies are integrally formed of non metallic materials, typically as injection molded plastic components. While this approach does respond to health concerns and certain environmental concerns, it does little to correct the tampering problem because the all plastic components are still susceptible to being heat softened to permit disconnection and reassembly without leaving observable traces of tampering.

A further attempt at providing an improved seal involves the combination of a metallic wire with a plastic body having inner and outer mutually adjustable components designed to grip arms of the wire threaded therethrough. Here again, however, heat softening of the plastic components can compromise seal integrity. Moreover, application of the seal body to the wire of certain seals requires the use of an expensive specially designed tool, which further increases overall costs while also unnecessarily burdening maintenance personnel.

A general object of the present invention is to provide a tamper evident seal which either obviates or at least significantly minimizes the above described problems associated with known prior art devices.

A more specific object of the present invention is the provision of a tamper evident seal having features which preclude tampering without residual visual evidence.

Another object of the present invention is the provision of a tamper evident seal that can be installed quickly and efficiently by maintenance personnel without the need to resort to the use of expensive specially designed tools.

SUMMARY OF THE INVENTION

The tamper evident seal of the present invention includes a hollow housing having a circular side wall with at least one first wall opening, a flexible elongated element in the form of a metallic wire protruding from the housing, a stem, torque responsive elements for rotating the stem in a first direction relative the housing, and rotation arresting elements. The stem includes a stem opening aligned at an initial setting with the first wall opening. The arresting elements oppose the rotation of the stem in a direction opposite the first direction.

After the wire is fed through the aligned apertures in the interlocked components to be safeguarded against tampering, it is fed through the first wall opening and the first stem opening. The stem is subsequently rotated with respect to the housing, thereby deformably wrapping the wire around the stem and thus locking it in place with the housing.

In a preferred embodiment to be hereafter described in greater detail, the housing wall has two oppositely disposed first wall openings, thereby accommodating a pass through of the wire prior to rotation of the stem. The housing is preferably transparent and closed at one end by a bottom wall. The stem is advantageously provided with a head accessible via the open top of the housing. Preferably, the stem head is recessed below the housing wall, and is provided with unidirectional torque receiving contact surfaces. The rotational arresting elements preferably comprise resilient pawls on the stem arranged to coact with ratchet teeth on the interior of the housing wall.

BRIEF DESCRIPTION OF THE DRAWINGS

The detailed description of the illustrated embodiments may be further understood with reference to the accompanying drawings in which.

DETAILED DESCRIPTION OF THE ILLUSTRATED EMBODIMENTS

Figure 1:
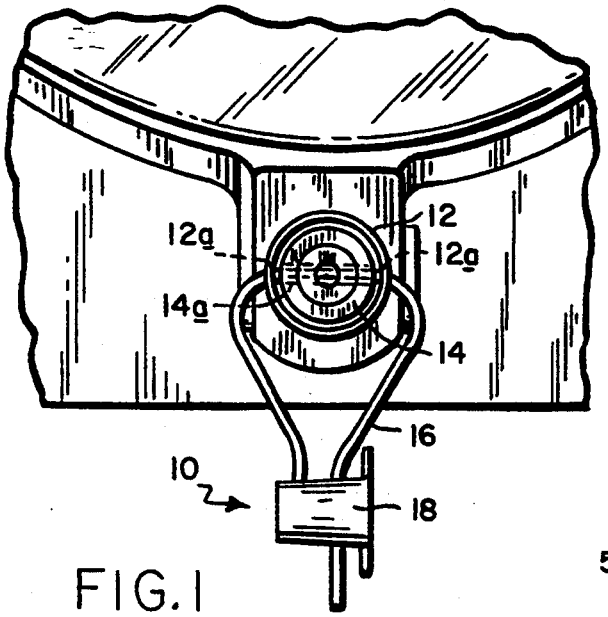
FIG. 1 is a partial view of interlocked components sealed with a tamper evident seal of the present invention.

With reference to FIG. 1, a tamper evident seal 10 of the present invention is intended for use with assembled components 12, 14 having mutually aligned apertures 12*a*, 14*a*. A flexible elongated element 16, which is a wire in the present embodiment, protrudes from the housing 18. The wire 16 is fed through the aligned apertures 12*a*, 14*a* and returned to the housing 18 where it is secured in accordance with the invention.

Figure 2:
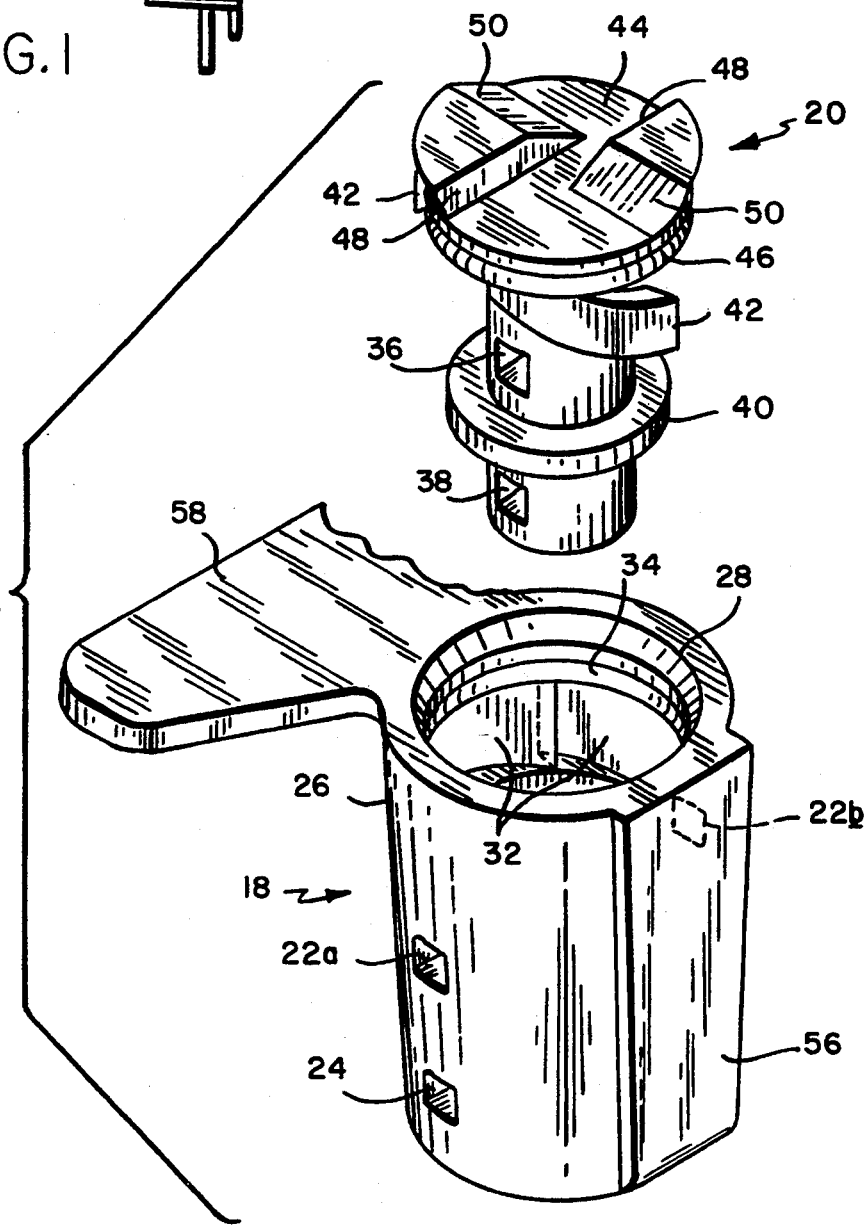
FIG. 2 is an exploded perspective view of the stem and housing.
Figure 4:
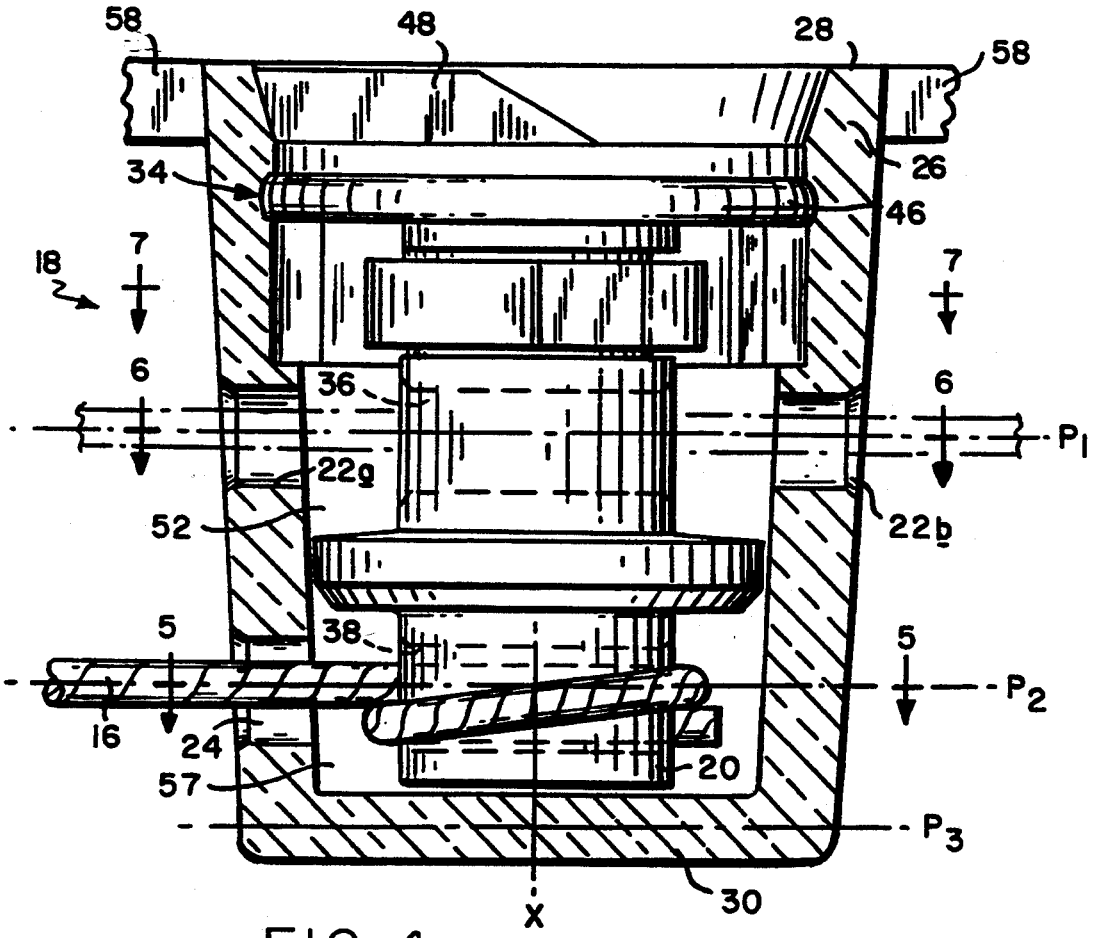
FIG. 4 is a cross-sectional view on an enlarged scale taken along line 4—4 of FIG. 3, and showing the wire wrapped around the stem and protruding through the housing.
Figure 3:
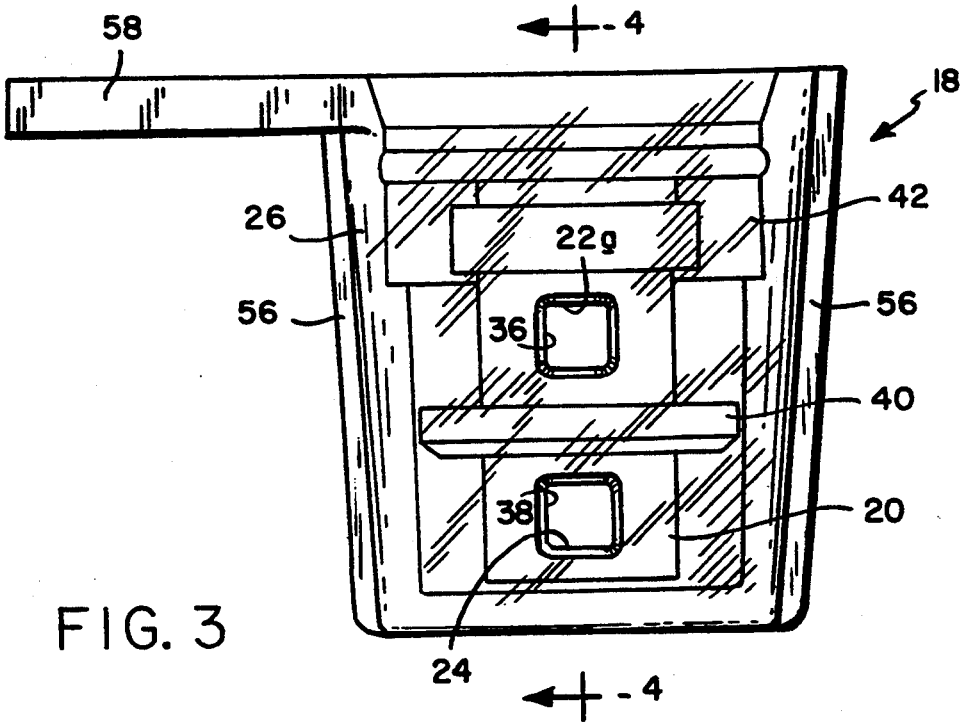
FIG. 3 is a side elevational view of the seal.

Referring to FIGS. 2, 3, and 4, it will be seen that the housing 18 contains a stem 20. The housing 18 includes a circular side wall 26 having first wall openings 22*a*, 22*b* disposed 180° apart in a first plane P1, and a second wall opening 24 in a second plane P2 parallel to the first plane P1. The top of the housing 18 is open and includes an upper edge 28 of the circular side wall 26. Spaced below the open top 28 are ratchet teeth 32 and an interior groove 34. The housing 18 also includes a bottom wall 30 in a third plane P3 as shown in FIG. 4. In alternative embodiments, the bottom wall could include a circular recess into which the stem would protrude.

The stem 20 is received within the hollow housing 18 as shown in FIGS. 3 and 4. The stem 20 includes a first opening 36, a second opening 38, a circular radial shoulder 40, two pawls 42, and a head portion 44. The head portion 44 includes an integral circular shoulder 46, torque contact surfaces 48, and torque ramp surfaces 50.

When the stem 20 is inserted into the housing 18, the integral circular shoulder 46 on the stem 20 engages with the interior groove 34 in the housing 18 in a snap fit. The head portion 44 of the stem 20 preferably is recessed below the top edge 28 of the wall 26. The pawls 42 on the stem 20 coact resiliently with the ratchet teeth 32 within the housing 18. The interior portion of the hollow housing 18 is divided into first and second annular chambers 52, 54 by the circular radial shoulder 40 on the stem 20.

Figure 5:
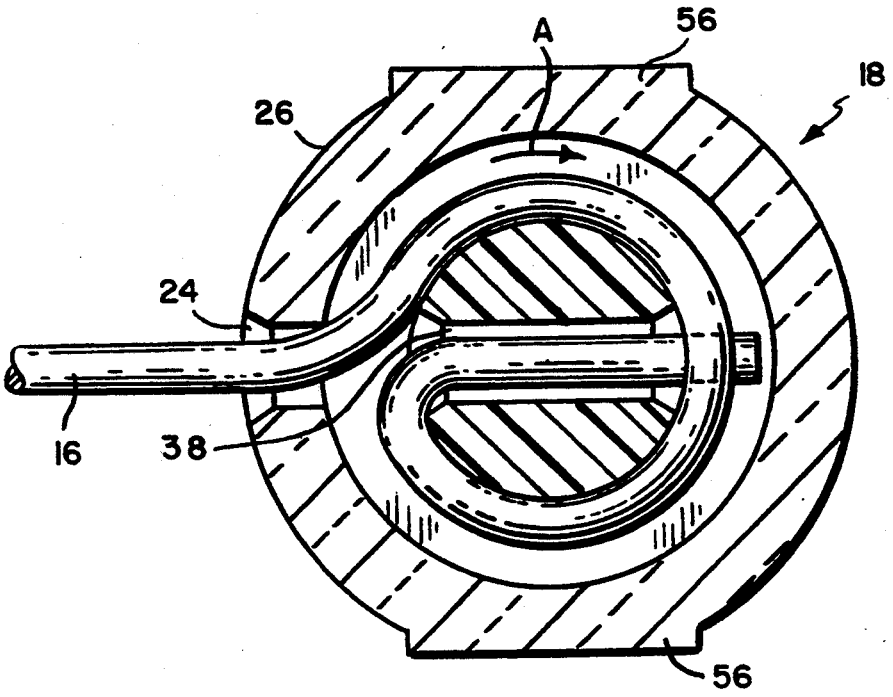
FIG. 5 is a cross-sectional view taken along line 5—5 of FIG. 4.

With reference to FIG. 5, the wire 16 is initially inserted through the second wall opening 24 as well as the second stem opening 38, and then wrapped about the stem 20 as it is rotated in a first direction indicated by solid arrow "A" in FIG. 5 with respect to the housing 18. The stem 20 is rotated about the x-axis as shown in FIG. 4 by applying a torque to the torque contact surfaces 48 with, for example, a flat head screw driver. The x-axis is substantially perpendicular to the first plane P1. The housing 18 may be held by gripping the opposing raised flat surfaces 56 disposed on the circular side wall at 90° to the wall openings 22, 24. Alternatively, the housing 18 may be held during rotation of the stem by gripping the tab 58 on the housing 18.

Figure 6A:
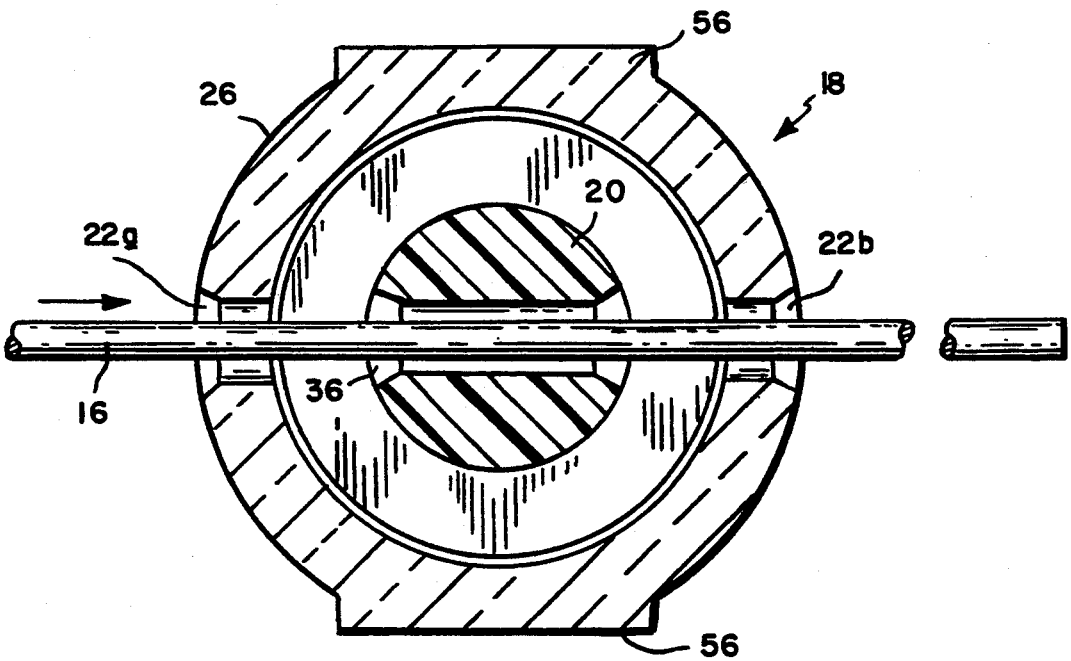
FIG. 6A is a cross-sectional view taken along line 6—6 of FIG. 4 and showing the wire inserted through the stem and housing.
Figure 6B:
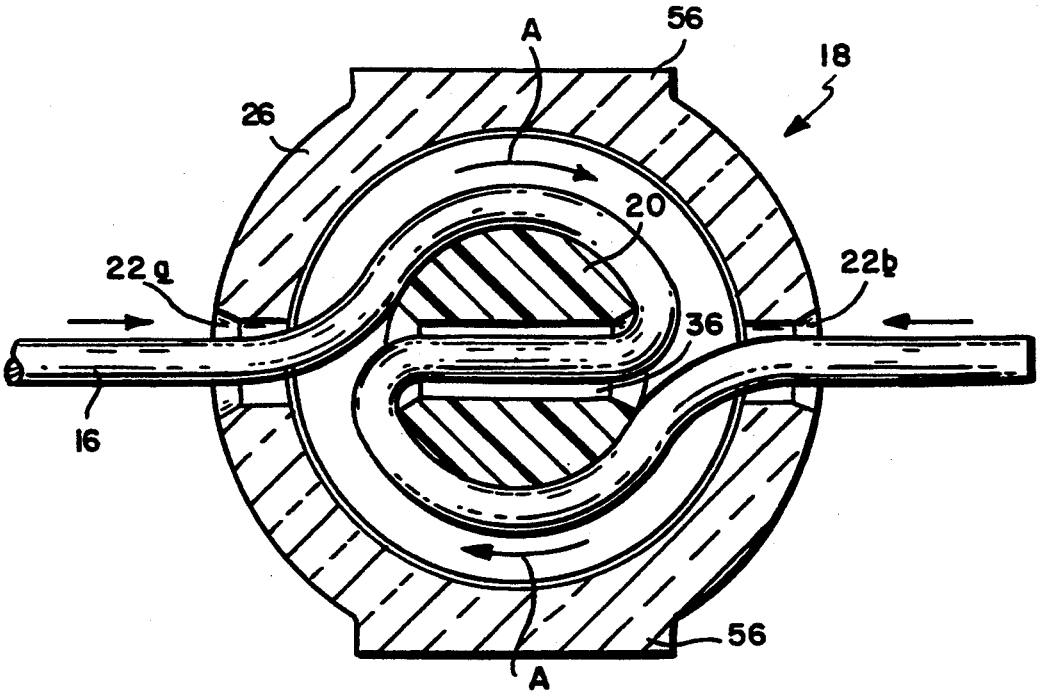
FIG. 6B is a cross-sectional view again taken along line 6—6 of FIG. 4, and showing the wire wrapped around the stem.

The stem 20 is preferably rotated a full revolution within the housing 18. In the present embodiment, the stem 20 must be rotated such that the first stem opening 36 and the first wall openings 22*a*, 22*b* are mutually realigned upon completion. The opposite free end 60 of the wire 16 is passed through the aligned apertures 12*a*, 14*a* of the assembled components 12, 14 and returned to the housing 18 and stem 20 unit. Referring additionally to FIGS. 6A and 6B, the free end 60 of the wire 16 is then passed through the first wall opening 22*a*, the first stem opening 36, and the first wall opening 22*b*. The free end 60 of the wire 16 should protrude from the wall opening 22*b* a sufficient distance such that when the stem 20 is again rotated in the first direction and the wire 16 is wrapped about the stem 20, at least a portion of the free end 60 of the wire 16 will continue to protrude exteriorly from the housing 18. As the stem 20 is rotated, the wire 16 will be wrapped around it and will accumulate within the two chambers 52, 54.

Figure 7:
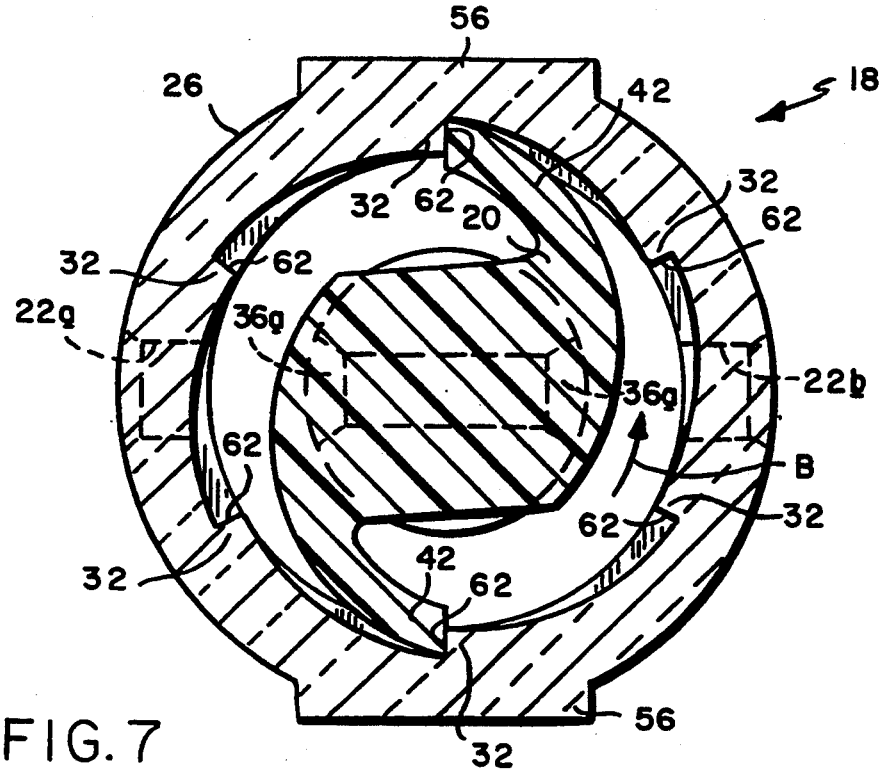
FIG. 7 is a cross-sectional view taken along line 7—7 of FIG. 4.

Although the stem 20 may be easily rotated in the first direction "A" to wrap the wire 16 about itself, the stem 20 is prohibited from rotating in the opposite direction (arrow "B" in FIG. 7) by the coaction of the pawls 42 and the ratchet teeth 32 as shown in FIGS. 2 and 7. As the stem 20 is rotated with respect to the housing 18 in the first direction "A", the pawls 42 resiliently flex and slide over the teeth 32, whereas rotation in the opposite direction "B" is opposed by the toothed engagement at 62. Pawls 42 are preferably disposed at 90° to the stem openings 36, 38, and the stop surfaces 62 of the teeth 32 are preferably disposed at 90° to the wall openings 22, 24. This facilitates alignment of the stem openings 36, 38 with the wall openings 22, 24 respectively. Additionally, in the present embodiment the torque ramp surfaces 50 thwart any attempt at applying torque to the stem 20 in the opposite direction "B".

The stem 20 and housing 18 are preferably manufactured of a thermoplastic material, and the housing 18 is preferably transparent. The flexible elongated element 16 is preferably a copper or steel wire.

In light of the foregoing, it will now be appreciated by those skilled in the art that the present invention provides a seal housing/stem combination which securely coacts with a wire or other like flexible element. In use, the wire is locked within the housing as a result of its being wrapped around the stem, the latter being rotatable in one direction to effect the wrap, but being constrained against reverse rotation by the ratchet and pawl arrangement. The housing is transparent, thereby facilitating visual inspection of the interlocked relationship of the interior components. No amount of heating short of permanent distortion of the housing and/or stem will suffice to disengage the pawls from the ratchet teeth. Thus, the wire cannot be extricated from the housing without residual visible evidence of tampering. In a preferred embodiment, the integral circular shoulder 46 on the stem 20 is tightly seated within the interior groove 34 in the housing 18 so as to foil any attempted introduction of a shim or other like tool between the housing 18 and the stem 20 for purposes of releasing the pawls 42 from the ratchet teeth 32.

Figure 8:
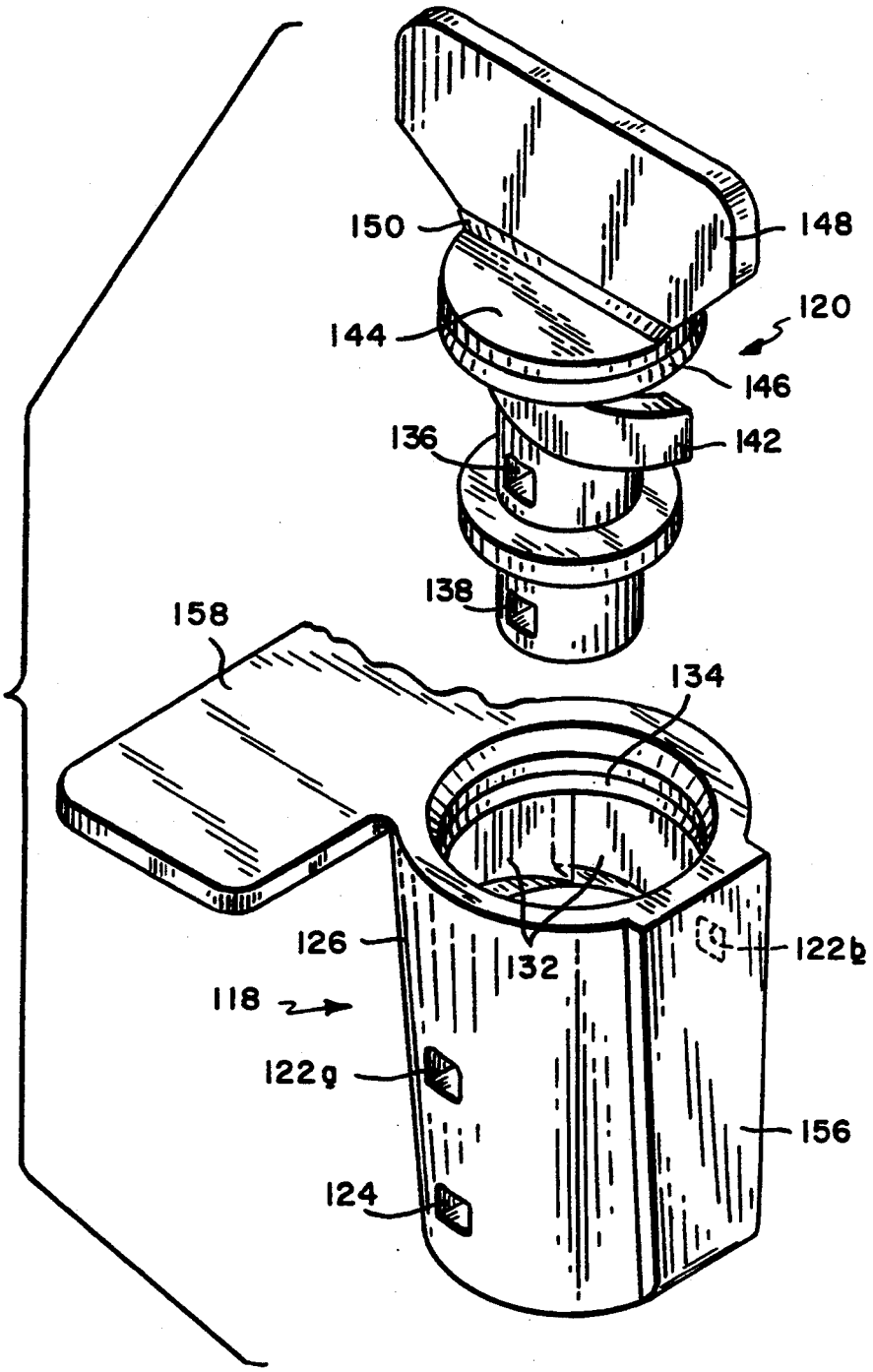
FIG. 8 is an exploded perspective view of a stem and housing of an alternative embodiment of the invention.

An alternative embodiment of the invention is shown in FIG. 8. The housing 118 includes a circular side wall 126 having first wall openings 122*a* and 122*b*, a second wall opening 124, ratchet teeth 132, an interior groove 134, flat surfaces 156 and tab 158. The stem 120 includes a first opening 136, a second opening 138, a circular radial shoulder 140, pawls 142, and a circular radial shoulder 146. The head portion 144 of the stem 120 includes an integral wing tab 148. The housing 118 and the stem 120 cooperate to secure a wire as described with reference to the embodiment of FIGS. 1–7. The stem 120 is rotated by applying a torque to the wing tab 148. The tab 148 is adapted to be broken from the head portion 144 of the stem 120 along break line 150 after the wire has been fully wound around the stem within the housing. Separation of the wing tab 148 from the stem 120 further prevents tampering.

Those skilled in the art will appreciate that numerous modifications may be made to the above disclosed embodiments without departing from the scope of the invention.

I claim:

1. A tamper evident seal for assembled components having aligned apertures, said seal comprising:

a hollow housing having a substantially circular side wall surrounding a central axis, said side wall having at least one first wall opening in a first plane substantially perpendicular to the central axis;

a stem contained within said housing for rotation about said axis, said stem having a stem opening aligned at an initial setting with said first wall opening;

a flexible elongated element secured in relation to and having a free end protruding exteriorly from said housing through a second wall opening in a second plane substantially parallel to said first plane;

torque responsive means for rotating said stem in one direction; and unidirectional rotation arresting means for opposing rotation of said stem relative to said housing in an opposite direction, whereupon in use the free end of said flexible element is passed through the aligned apertures of said assembled components and then through said substantially circular side wall and stem via said first wall opening and said stem opening, and the stem is then rotated in said one direction relative to said housing to wrap a segment of said element about said stem.

2. A tamper evident seal as claimed in claim 1, wherein said hollow housing further includes another first wall opening such that said first wall openings are at locations disposed 180° apart in said first plane, whereupon in use the free end of said flexible element is passed through the aligned apertures of said assembled components and then through said housing and stem via said first wall and stem openings.

3. A tamper evident seal as claimed in claim 1, wherein said hollow housing further includes a bottom wall within a third plane such that said second plane lies between said first plane and said third plane.

4. A tamper evident seal as claimed in claim 1, wherein said hollow housing is made of a thermoplastic material.

5. A tamper evident seal as claimed in claim 1, wherein said stem is made of a thermoplastic material.

6. A tamper evident seal as claimed in claim 1, wherein said hollow housing is substantially transparent.

7. A tamper evident seal as claimed in claim 1, wherein said torque responsive means is unidirectional.

8. A tamper evident seal as claimed in claim 1, wherein said torque responsive means includes contact surfaces on said stem to which torque may be applied to rotate said stem about said axis in said one direction; and ramp means for deflecting the application of torque away from said contact surfaces in said opposite direction.

9. A tamper evident seal as claimed in claim 1, wherein said torque responsive means includes a wing tab.

10. A tamper evident seal as claimed in claim 9, wherein said wing tab is capable of being separated from said stem.

11. A tamper evident seal as claimed in claim 1, wherein said hollow housing has an open top, and said stem has a head accessible via said open top.

12. A tamper evident seal as claimed in claim 11, wherein said torque responsive means is integrally formed on the head of said stem.

13. A tamper evident seal as claimed in claim 11, wherein said the open top of said housing is defined by a circular wall having an upper edge, and wherein the head of said stem is recessed below said upper edge.

14. A tamper evident seal as claimed in any one of claims 11–13, wherein the substantially circular side wall of said hollow housing is further provided with an interior groove adjacent said open top, and wherein the head of said stem includes an integral circular shoulder snap fitted into said interior groove.

15. A tamper evident seal as claimed in claim 1, wherein said stem cooperates in spaced relationship with the substantially circular side wall of said housing to define an annular space therebetween, said stem having a circular radial shoulder coacting with said side wall to subdivide said space into first and second chambers, said first and second wall openings communicating respectively with said first and second chambers.

16. A tamper evident seal as claimed in claim 1, wherein said flexible elongated element is metallic.

17. A tamper evident seal as claimed in claim 1, wherein said unidirectional rotational arresting means includes tooth means on one of said stem or housing components, and pawl means on the other of said stem or housing components, said pawl means adapted to coact with said tooth means to limit rotation of said stem relative to said housing in said one direction.

18. A tamper evident seal for assembled components having mutually aligned apertures, said seal comprising:

a hollow housing having a substantially circular side wall surrounding a central axis, said side wall having mutually aligned first wall openings at locations disposed 180° apart in a first plane perpendicular to said axis, and having a second wall opening at one of said locations in a second plane parallel to said first plane;

a stem contained within said housing for rotation about said axis, said stem having first and second through stem openings located respectively in said first and second planes and respectively aligned at an initial rotative setting with said first and second wall openings;

a flexible elongated element having one end protruding into said housing via said second wall opening and through the second stem opening in alignment therewith, said flexible element having a segment thereof adjacent to said one end wrapped at least once around said stem as a result of said stem being rotated in one direction relative to said housing, the opposite free end of said flexible element protruding exteriorly of said housing;

torque responsive means for rotating said stem about said axis; and unidirectional rotational arresting means for opposing rotation of said stem relative to said housing in a direction opposite to said one direction, whereupon in use the free end of said flexible element is passed through the aligned apertures of said assembled components and then through said housing and stem via said first wall and stem openings, and the stem is then rotated in said one direction relative to said housing to wrap another segment of said element about said stem.

19. A tamper evident seal for assembled components having mutually aligned apertures, said seal comprising:

a substantially transparent hollow housing made of a thermoplastic material having a circular side wall surrounding a central axis and including an interior groove, said side wall having mutually aligned first wall openings at locations disposed 180° apart in a first plane perpendicular to said axis, a second wall opening at one of said locations in a second plane parallel to said first plane, a bottom wall within a third plane such that said second plane lies between said first plane and said third plane, and an open top adjacent said interior groove and defined by a circular wall having an upper edge;

a stem made of a thermoplastic material contained within said housing for rotation about said axis and for cooperating in spaced relationship with the circular side wall of said housing to define an annular space therebetween, said stem including first and second through stem openings located respectively in said first and second planes and respectively aligned at an initial rotative setting with said first and second wall openings, a head recessed below and accessible via said open top of said housing, an integral circular shoulder snap fitted into said interior grooves, and a circular radial shoulder coacting with said side wall to subdivide said space into first and second chambers communicating with said first and second wall openings respectively;

a flexible elongated element made of a metallic material having one end protruding into said housing via said second wall opening and through the second stem opening in alignment therewith, said flexible element having a segment thereof adjacent to said one end wrapped at least once around said stem as a result of said stem being rotated in one direction relative to said housing, the opposite free end of said flexible element protruding exteriorly of said housing;

unidirectional torque responsive means integrally formed on the head of said stem for rotating said stem about said axis in one direction, said torque responsive means including contact surfaces on said stem to which torque may be applied to rotate said stem about said axis in said one direction; and ramp means for deflecting the application of torque away from said contact surfaces in said opposite direction; and rotational arresting means for opposing rotation of said stem relative to said housing in a direction opposite to said one direction, said rotational arresting means including tooth means on one side of said stem or housing components, and pawl means adapted to coact with said tooth means to limit rotation of said stem relative to said tooth means to limit rotation of said stem relative to said housing in said one direction, whereupon in use the free end of said flexible element is passed through the aligned apertures of said assembled components and then through said housing and stem via said first wall and stem openings, and the stem is then rotated in said one direction relative to said housing to wrap another segment of said element about said stem.

20. A tamper evident seal for assembled components having aligned apertures, said seal comprising:

a hollow housing having a substantially circular side wall surrounding a central axis, said side wall including a first wall opening, a second wall opening such that said first and second wall openings are at locations disposed 180° apart in a first plane substantially perpendicular to the central axis, and a third wall opening at one of said locations of said first and second wall openings in a second plane substantially parallel to said first plane;

a stem contained within said housing for rotation about said axis, said stem having a stem opening aligned at an initial setting with said first wall opening;

a flexible elongated element secured in relation to and having a free end protruding exteriorly from said housing, said free end of said elongated element being insertable through the aligned apertures of said assembled components and then through said housing and stem via said first, second, and stem openings;

unidirectional torque responsive means for rotating said stem in one direction; and rotation arresting means for opposing rotation of said stem relative to said housing in an opposite direction, whereupon in use the free end of said flexible element is passed through the aligned apertures of said assembled components and then through said substantially circular side wall and stem via said first wall opening and said stem opening, and the stem is then rotated in said one direction relative to said housing to wrap a segment of said element about said stem.

21. A tamper evident seal as claimed in claim 20, wherein said unidirectional torque responsive means includes contact surfaces on said stem to which torque may be applied to rotate said stem about said axis in said one direction; and ramp means for deflecting the application of torque away from said contact surfaces in said opposite direction.

22. A tamper evident seal for assembled components having aligned apertures, said seal comprising:

a hollow housing having a substantially circular side wall surrounding a central axis, said side wall including a first wall opening, a second wall opening such that said first and second wall openings are at locations disposed 180° apart in a first plane substantially perpendicular to the central axis, and a third wall opening at one of said locations of said first and second wall openings in a second plane substantially parallel to said first plane;

a stem contained within said housing for rotation about said axis, said stem having a stem opening aligned at an initial setting with said first wall opening;

a flexible elongated element secured in relation to and having a free end protruding exteriorly from said housing, said free end of said elongated element being insertable through the aligned apertures of said assembled components and then through said housing and stem via said first, second, and stem openings;

torque responsive means for rotating said stem in one direction, said torque responsive means including a wing tab capable of being separated from said stem; and rotation arresting means for opposing rotation of said stem relative to said housing in an opposite direction, whereupon in use the free end of said flexible element is passed through the aligned apertures of said assembled components and then through said substantially circular side wall and stem via said first wall opening and said stem opening, and the stem is then rotated in said one direction relative to said housing to wrap a segment of said element about said stem.

23. A tamper evident seal for assembled components having aligned apertures, said seal comprising:

a hollow housing having a substantially circular side wall surrounding a central axis, said side wall including a first and a second wall opening;

a stem contained within said housing for rotation about said axis, said stem including a radially extending shoulder member defining first and second chambers within said housing, and further including first and second stem openings aligned at an initial setting with said first and second wall openings respectively, both of said first openings being disposed within said first chamber and both of said second openings being disposed within said second chamber;

a flexible elongated element having a first end and a second end, said first end being secured to said stem through said first openings and said second end protruding exteriorly of said housing, whereupon in use the second end of said flexible element is passed through the aligned apertures of said assembled components and then through said second wall and second stem openings, and the stem is then rotated in one direction relative to said housing to wrap a first segment of said element about said stem within said first chamber and a second segment of said element about said stem within said second chamber.

* * * * *